US011685639B2

(12) United States Patent
Hall et al.

(10) Patent No.: US 11,685,639 B2
(45) Date of Patent: Jun. 27, 2023

(54) CAPSTAN EFFECT DEVICE

(71) Applicant: Hall Labs LLC, Provo, UT (US)

(72) Inventors: David R. Hall, Provo, UT (US); Michael Hall, Provo, UT (US); Cody Rees, Provo, UT (US)

(73) Assignee: Hall Labs LLC, Provo, UT (US)

( * ) Notice: Subject to any disclaimer, the term of this patent is extended or adjusted under 35 U.S.C. 154(b) by 490 days.

(21) Appl. No.: 16/820,577

(22) Filed: Mar. 16, 2020

(65) Prior Publication Data

US 2021/0285525 A1 Sep. 16, 2021

(51) Int. Cl.
*B66D 1/36* (2006.01)

(52) U.S. Cl.
CPC ..... *B66D 1/36* (2013.01); *B66D 2700/0141* (2013.01); *B66D 2700/0191* (2013.01)

(58) Field of Classification Search
CPC ..... B66D 1/30; B66D 1/36; B66D 1/7405; B66D 1/7415; B66D 1/7421; B66D 1/7426; B66D 1/7442; B66D 2700/0191; B66D 3/04; B66B 11/08; B66B 11/008
See application file for complete search history.

(56) References Cited

U.S. PATENT DOCUMENTS

| | | | | |
|---|---|---|---|---|
| 3,273,408 | A * | 9/1966 | Nagel | F16H 35/00 400/322 |
| 6,182,915 | B1 * | 2/2001 | Kvalsund | B66D 1/7405 254/290 |
| 8,689,636 | B2 * | 4/2014 | Bednarczyk | B65H 63/00 73/800 |
| 2012/0126048 | A1 * | 5/2012 | Lervik | B66D 1/741 242/410 |
| 2021/0301907 | A1 * | 9/2021 | Hall | B66B 1/52 |
| 2022/0324683 | A1 * | 10/2022 | Hall | B66D 1/74 |

FOREIGN PATENT DOCUMENTS

| | | | | |
|---|---|---|---|---|
| GB | 547237 | A1 * | 8/1942 | B66D 3/04 |
| GB | 2131381 | A * | 6/1984 | B66B 11/08 |

* cited by examiner

*Primary Examiner* — Sang K Kim
*Assistant Examiner* — Nathaniel L Adams

(57) ABSTRACT

A device for moving an object is disclosed. The device has a drive cylinder with drive grooves and a set of idler pulleys. The idler pulleys are on a shaft that is parallel to the drive cylinder. Each of the idler pulleys rotate at an angle around the drive shaft that aligns the grooves of the idler pulleys to neighboring drive grooves. This allows the line to pass onto the drive groove, around an idler pulley, and onto a next adjacent drive groove. The line therefore winds back and forth between the drive grooves, the idler pulleys, and back to the next drive groove. One end of the line is placed under tension and the other is attached to an object or to a fixed member. The drive cylinder is driven and the line is moved through the device, or the device is moved along the line, respectively.

20 Claims, 11 Drawing Sheets

CAPSTAN EFFECT DEVICE

TECHNICAL FIELD

This disclosure relates generally to capstan-like motive devices.

BACKGROUND

Winches and hoists have proven useful tools in moving objects of considerable size and weight. Winches function by winding or unwinding the line that is coiled around a horizontal rotating drum and thereby pulling a load. A hoist is a device used for lifting or lowering a load by means of a drum or lift-wheel around which the line wraps. In both instances, spooling of the line around the drum or similar causes wear on the line and other issues. Improved winching, hoisting, and climbing devices are needed.

SUMMARY

In a first aspect, the disclosure provides a device for moving an object. A drive cylinder has at least three drive grooves rotating in parallel planes that are perpendicular to a long axis of the drive cylinder. A shaft parallel to the drive cylinder has at least two idler pulleys that rotate. The idler pulleys rotate in planes parallel to each other and at an angle to the parallel planes of the drive grooves. As a line passes around a first drive groove, onto a first idler pulley, and around the first idler pulley, the line, as it comes off the first idler pulley, is aligned with a second drive groove. As the line comes around the second drive groove, onto a second idler pulley, and around the second idler pulley, the line, as it comes off the second idler pulley, is aligned with a third drive groove. The line is attached at a first end to an object and a second end is under tension. As the drive cylinder is rotated the object is moved.

In a second aspect, the disclosure provides a device for moving an object. A drive cylinder has at least three drive grooves rotating in parallel planes that are perpendicular to a long axis of the drive cylinder. The drive cylinder is mounted to the object. A shaft is parallel to the drive cylinder upon which at least two idler pulleys rotate. The idler pulleys rotate in planes parallel to each other and at an angle to the parallel planes of the drive grooves. As a line passes around a first drive groove, onto a first idler pulley, and around the first idler pulley, the line, as it comes off the first idler pulley, is aligned with a second drive groove. As the line comes around the second drive groove, onto a second idler pulley, and around the second idler pulley, the line, as it comes off the second idler pulley, is aligned with a third drive groove. The line is attached at a first end to a stationary member and is attached at a second end to a stationary member or is under tension. As the drive cylinder is rotated the device travels along the line towards the first end or the second end, moving the object.

Further aspects and embodiments are provided in the foregoing drawings, detailed description and claims.

BRIEF DESCRIPTION OF THE DRAWINGS

The following drawings are provided to illustrate certain embodiments described herein. The drawings are merely illustrative and are not intended to limit the scope of claimed inventions and are not intended to show every potential feature or embodiment of the claimed inventions. The drawings are not necessarily drawn to scale; in some instances, certain elements of the drawing may be enlarged with respect to other elements of the drawing for purposes of illustration.

DETAILED DESCRIPTION

Figure 1:
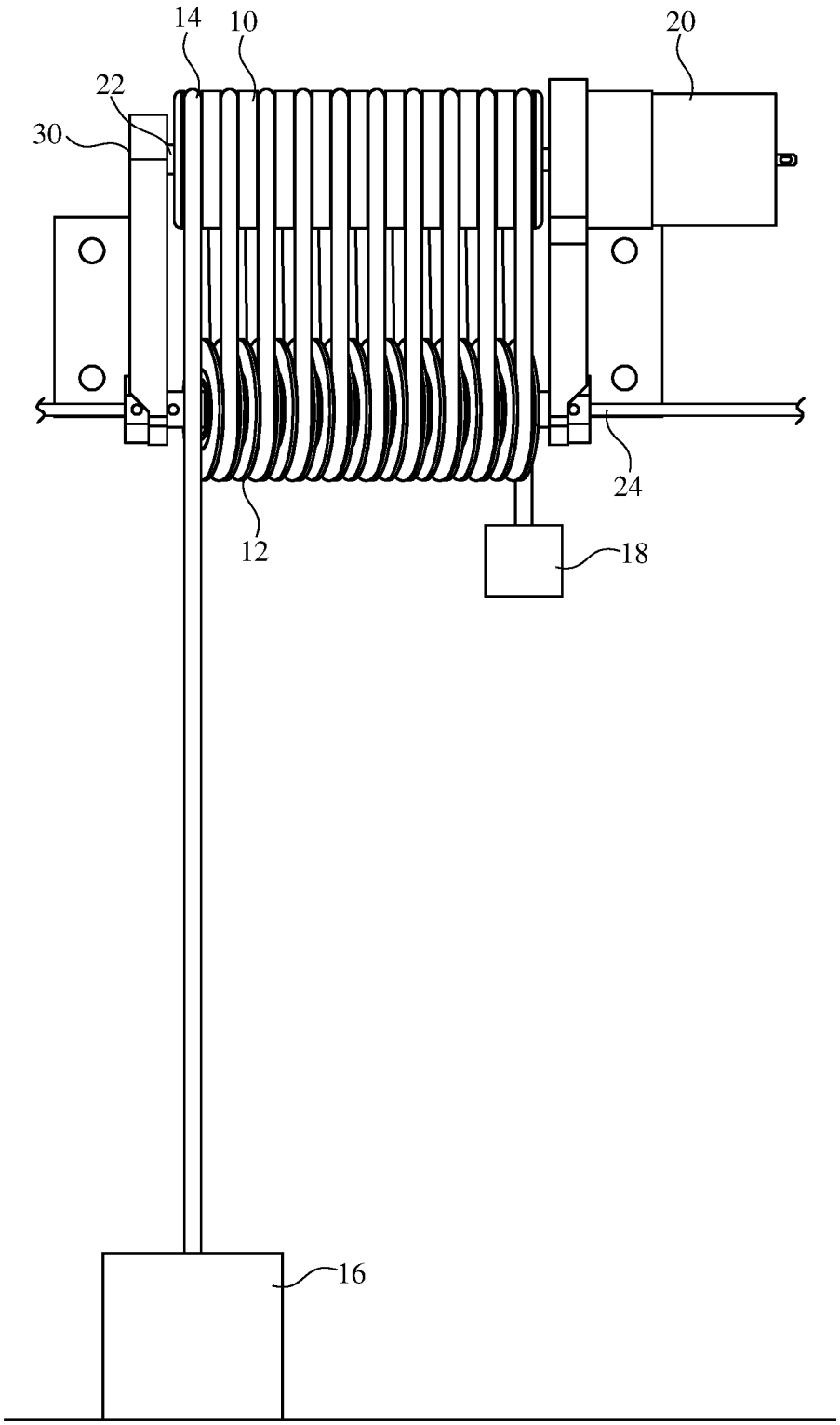
FIG. 1 is an elevation view of a device for lifting an object, the object on the ground.

The following description recites various aspects and embodiments of the inventions disclosed herein. No particular embodiment is intended to define the scope of the invention. Rather, the embodiments provide non-limiting examples of various compositions, and methods that are included within the scope of the claimed inventions. The description is to be read from the perspective of one of ordinary skill in the art. Therefore, information that is well known to the ordinarily skilled artisan is not necessarily included.

Definitions

The following terms and phrases have the meanings indicated below, unless otherwise provided herein. This disclosure may employ other terms and phrases not expressly defined herein. Such other terms and phrases shall have the meanings that they would possess within the context of this disclosure to those of ordinary skill in the art. In some instances, a term or phrase may be defined in the singular or plural. In such instances, it is understood that any term in the singular may include its plural counterpart and vice versa, unless expressly indicated to the contrary.

As used herein, the singular forms "a," "an," and "the" include plural referents unless the context clearly dictates otherwise. For example, reference to "a substituent" encompasses a single substituent as well as two or more substituents, and the like.

As used herein, "for example," "for instance," "such as," or "including" are meant to introduce examples that further clarify more general subject matter. Unless otherwise expressly indicated, such examples are provided only as an aid for understanding embodiments illustrated in the present disclosure and are not meant to be limiting in any fashion. Nor do these phrases indicate any kind of preference for the disclosed embodiment.

As used herein, "line" is meant to refer to any device or material that is long, cylindrical, thin, flexible, and having a high tensile strength. Preferably, this will be a braided wire, but ropes, cords, string, twine, cable, strand, chains and combinations thereof may be used as well.

As used herein, "capstan effect" is meant to refer to the small holding force exerted on a line by one side of a cylinder and the line therefore being able to carry a much larger loading force on the other side, as shown in the Capstan equation. Rotation of the cylinder multiplies the applied tension by the friction between the line and the cylinder.

Capstan effect devices are used to lift and pull objects, but typical capstan effect devices have some limitations. The line wrapping around the drum overlaps or rubs against itself. The line naturally would exit and enter typical capstan effect devices at whatever location the line comes off the drum. These and other limitations are overcome in the present invention. The present invention is a capstan effect device that uses both a drive cylinder and a line-transitioning set of idler pulleys. The drive cylinder has drive grooves perpendicular to the long axis of the drive cylinder. The idler pulleys are on a shaft that is parallel to the drive cylinder. However, the idler pulleys rotate at an angle around the drive shaft that allows the grooves of the idler pulleys to align with neighboring drive grooves. This allows the line to pass onto the drive groove, around an idler pulley, and from the idler pulley onto a next adjacent drive groove. The line therefore winds back and forth between the drive grooves, the idler pulleys, and back to the next drive groove. One end of the line is placed under tension and the other is attached to an object or to a fixed member. The drive cylinder is then driven and the capstan effect is utilized to move the line through the device, or to move the device along the line, respectively. The line thereby always exits and enters the system at the same place—the ends of the drum, eliminating one difficulty. Further, the line does not overlap and rub on itself, eliminating this friction damage to the line.

Figure 2:
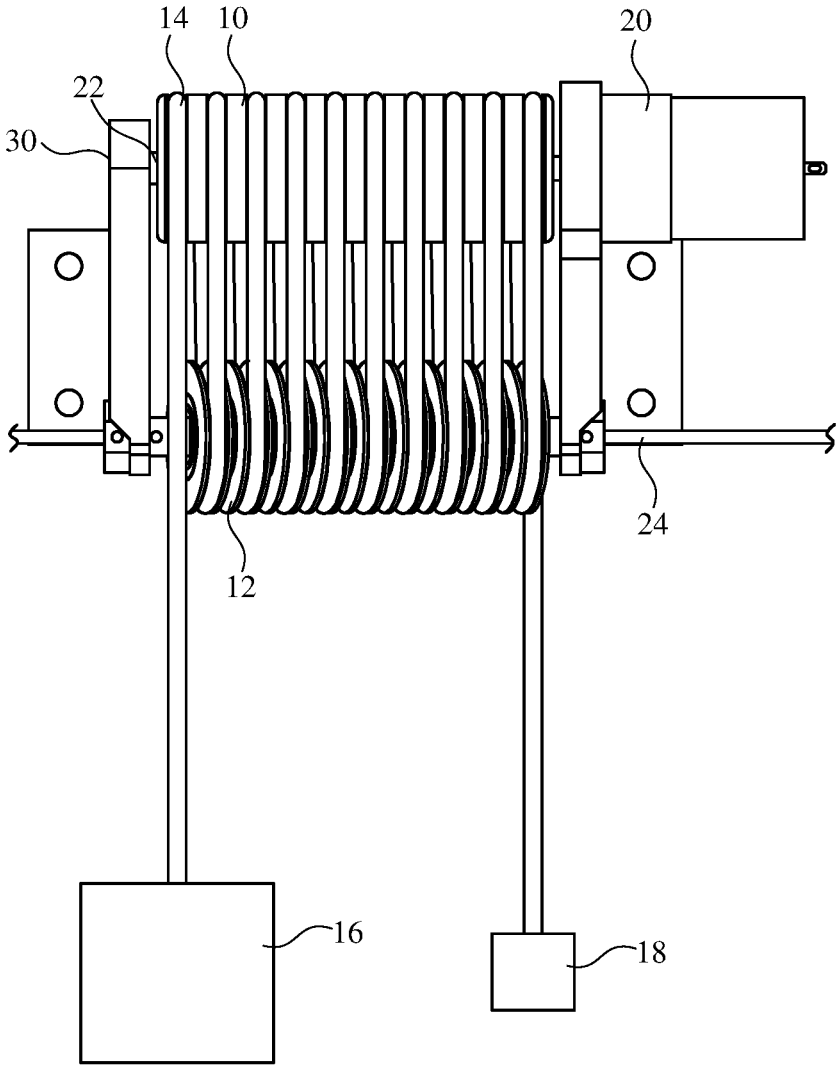
FIG. 2 is an elevation view of the device of FIG. 1, the object elevated partway to the device.
Figure 3:
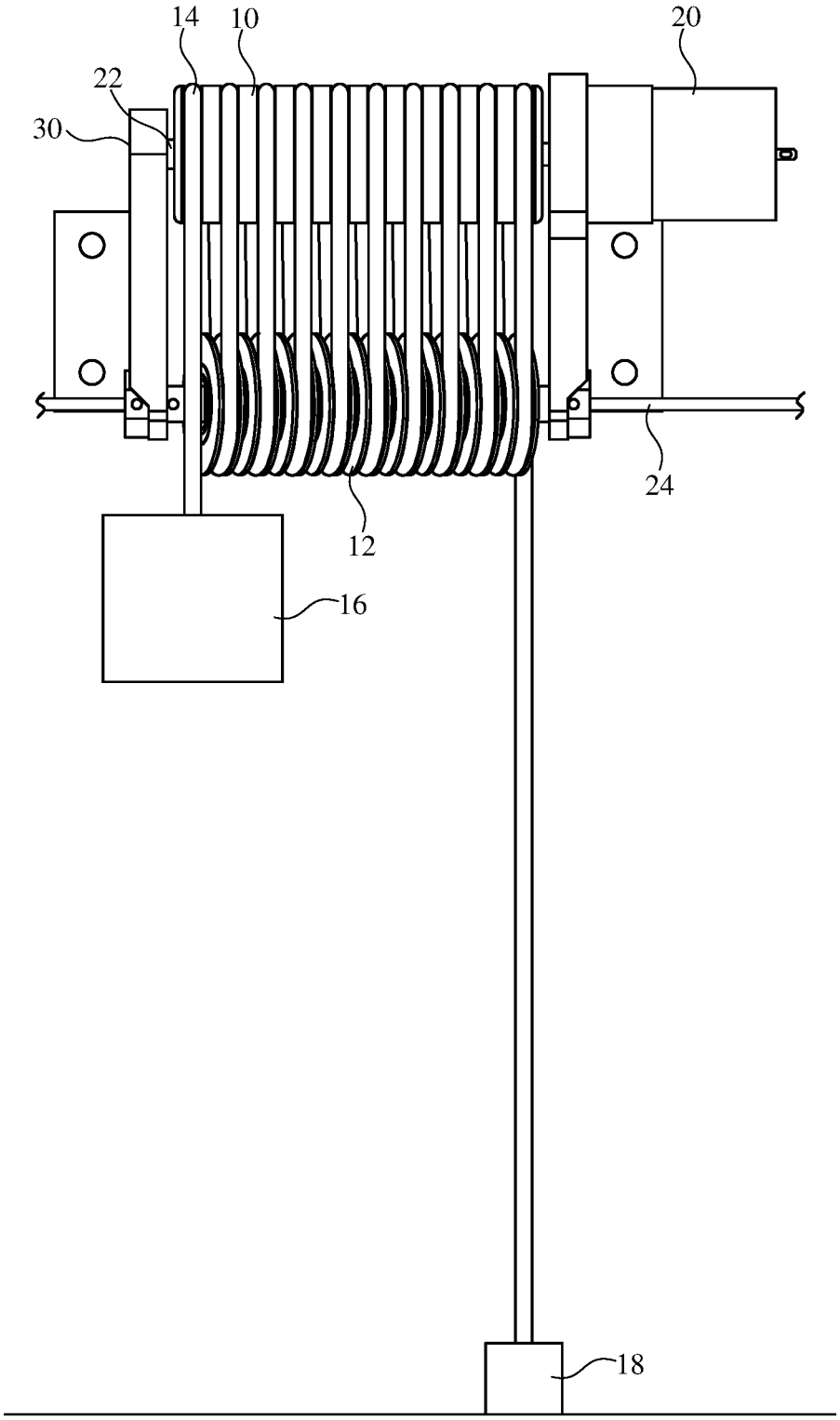
FIG. 3 is an elevation view of the device of FIG. 1, the object elevated all the way.
Figure 4:
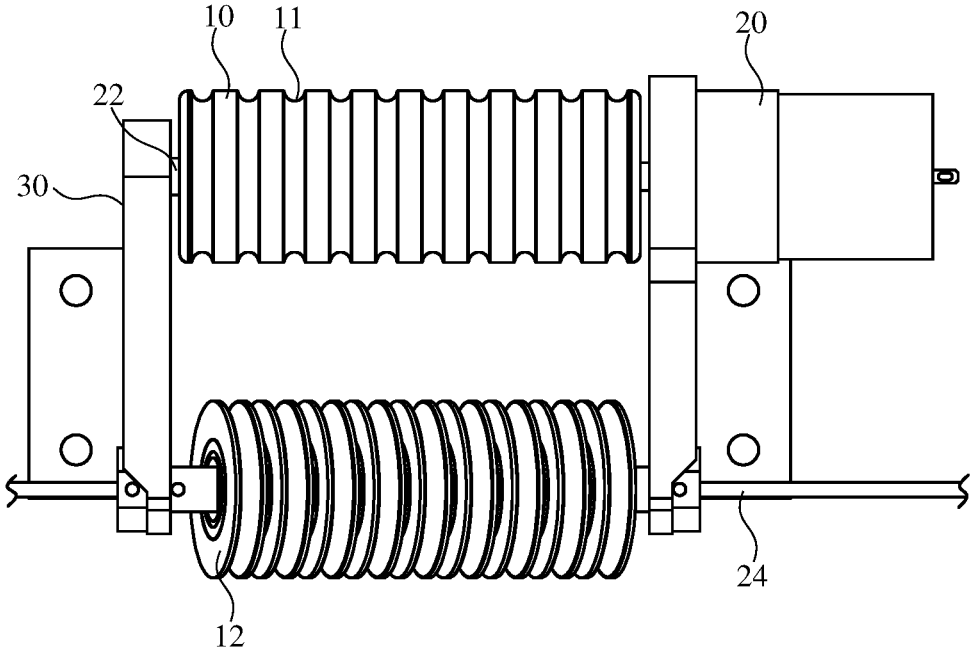
FIG. 4 is an elevation view of the device of FIG. 1 with the line removed.
Figure 5:
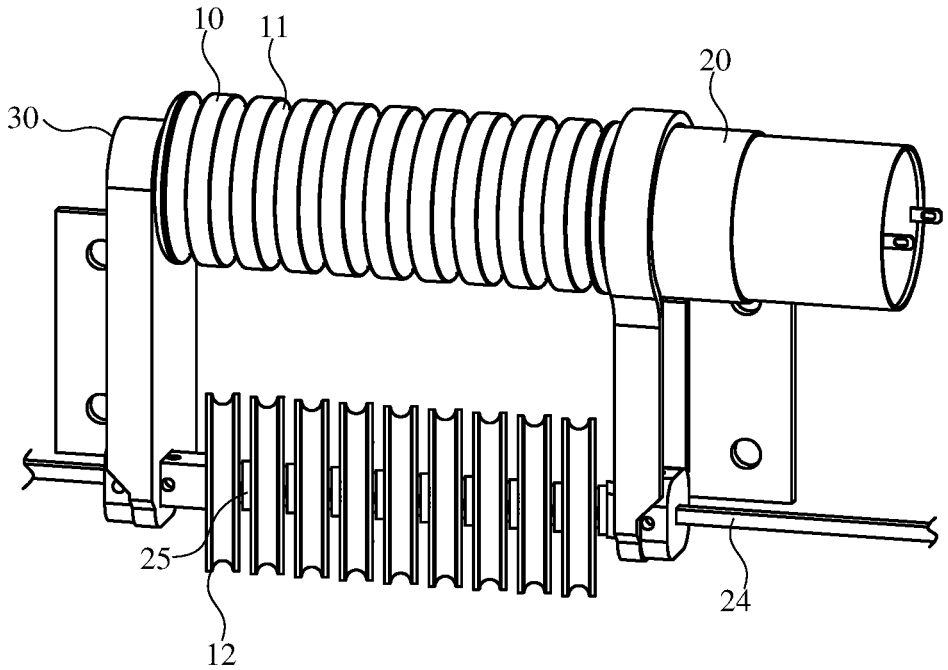
FIG. 5 is an isometric view of the device of FIG. 1 with the line removed.

Now referring to FIG. 1, FIG. 1 is an elevation view of a device 30 for lifting an object 16 that may be used in one embodiment of the present invention, the object in FIG. 1 on the ground. FIG. 2 is an elevation view of the device 30 of FIG. 1, the object 16 elevated partway to the device. FIG. 3 is an elevation view of the device 30 of FIG. 1, the object 16 elevated all the way. FIG. 4 is an elevation view of the device 30 of FIG. 1 with the line 14 removed. FIG. 5 is an isometric view of the device 30 of FIG. 1 with the line 14 removed. A drive cylinder 10 rotates on a drive shaft 22 driven by a motor 20. The drive cylinder 10 has drive grooves 11 that are parallel to one another and perpendicular to the long axis of the drive cylinder 10. Parallel to the drive shaft 22 is an idler shaft 24 with angled idler bearings 25 on which idler pulleys 12 rotate parallel to one another and at an angle to the drive grooves 11. The angle is such that as the line 14 passes around a first of the drive grooves 11 and onto a first of the idler pulleys 12, the line 14, as it comes off the first of the idler pulleys 12, is aligned with a second of the drive grooves 11. This continues across the device 30, with each drive groove 11 being fed line 14 from one of the idler pulleys 12 and then feeding that line 14 to a next of the idler pulleys 12. In other words, the angle is sufficient that the line 14 coming off each side of a drive groove 11 aligns with neighboring idler pulleys 12. This angle eliminates side loading of the idler pulleys 12. A counterweight 18 keeps the line 14 under tension. The wrapping and counterweight 18 produces a capstan effect on the line 14 such that turning the drive cylinder 10 clockwise (from the end of the motor 20) causes the line 14 holding the object 16 to be drawn in, lifting the object 16 and lowering the counterweight 18 towards the ground. Turning the drive cylinder 10 counterclockwise causes the line 14 holding the object 16 to be let out, lowering the object 16. This is shown in FIGS. 1, 2, and 3, as the object 16 is on the ground, lifted partway, and lifted all the way, respectively.

One benefit of the device 30 is that the object cannot be lowered if the drive cylinder 10 is not actively turned as the capstan effect acts as a friction lock, meaning that no locking mechanism is required in case of power loss, only the counterweight or other line tensioning device. This makes the device 30 inherently safer than many traditional lifting devices.

In preferred embodiments, the number of drive grooves is one greater than the number of idler pulleys.

The surface of the grooves is preferably designed so as to provide the right balance between friction and wear on the line. In other words, the total surface of the grooves that engages the line need to have enough friction, i.e. grip, with the line so that the line can be pulled by rotation of the drive cylinder. Likewise, the surface of the grooves should not have so much friction, e.g. roughness, so that the line wears unnecessarily as it is passed over the grooves repeatedly.

The more grooves and the bigger the area of contact between the grooves and the line means that each groove needs less friction. In some embodiments, there are only three drive grooves and only two idler pulleys. In other embodiments, there are only two drive grooves and one idler pulley. In a preferred embodiment, there are at least five grooves and four pulleys. In a more preferred embodiment, as in FIGS. 1-5, there are at least ten grooves and at least nine pulleys. The fewer the grooves, the greater the friction required on the surface or the greater the counterweight or force supplied by another tensioning device. The surface of the grooves can be tailored with special coatings, such as a soft polymeric coating, e.g. urethane or rubber, that would provide a better grip on the line. Alternatively, the surface of the grooves can be roughened, for example by etching, abrading or the like. Also, the outer surface of the line itself may be tailored with polymers coatings and the like, so as to provide more grip on the rollers.

In some embodiments, the surfaces of the drive grooves 11 are sufficiently rough to cause sufficient friction to eliminate the need for the counterweight 18 to provide tension on the line—the friction provides all the tension required.

Figure 6:
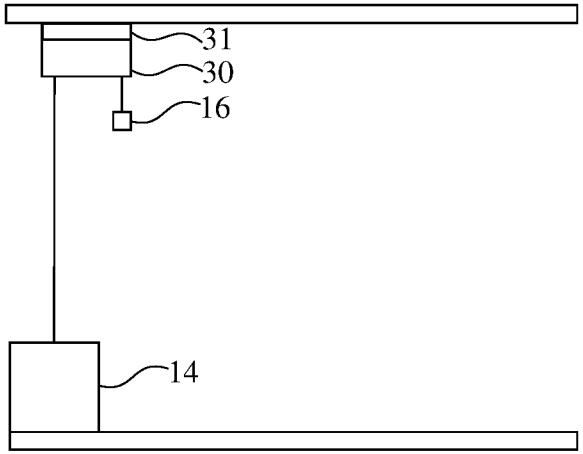
FIG. 6 is a block diagram of a system for lifting an object and moving the object translationally.
Figure 7:
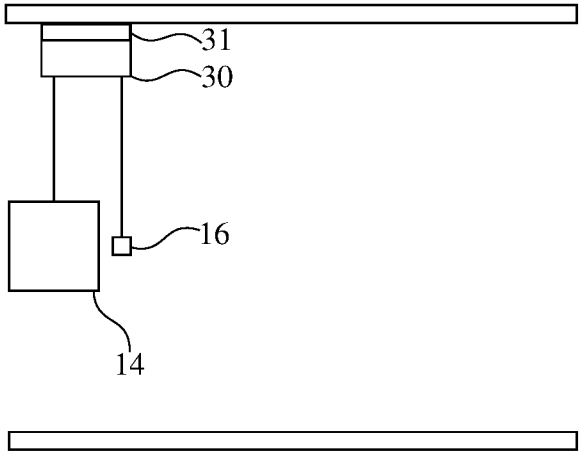
FIG. 7 is a block diagram of the system of FIG. 6, the object lifted.
Figure 8:
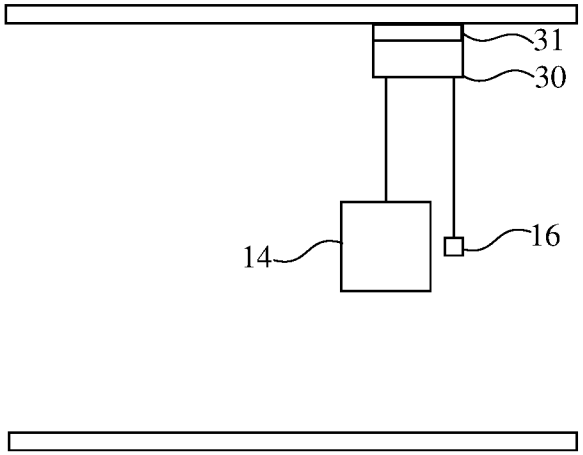
FIG. 8 is a block diagram of the system of FIG. 7, the object moved translationally.
Figure 9:
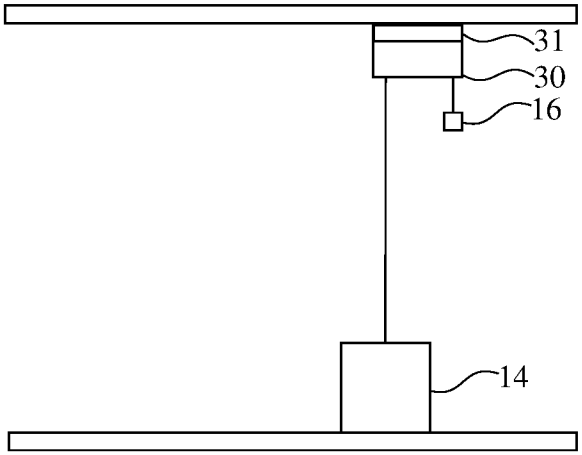
FIG. 9 is a block diagram of the system of FIG. 8, the object lowered to the ground.

FIG. 6 is a block diagram of a system for lifting an object and moving the object translationally that may be used in one embodiment of the present invention. FIG. 7 is a block diagram of the system of FIG. 6, the object lifted. FIG. 8 is a block diagram of the system of FIG. 7, the object moved translationally. FIG. 9 is a block diagram of the system of FIG. 8, the object lowered to the ground. An object 14 is on the ground (FIG. 6), lifted (FIG. 7), moved translationally (FIG. 8) and placed on the ground (FIG. 9). The lifting device 30 consists of a device as in FIGS. 1-5 with a counterweight 16. The lifting device 30 is mounted to a track follower 31 that moves the system translationally after the object 14 is lifted. In this manner, the object 16 can be elevated, moved, and set in a new location using only the capstan effect. As mentioned previously, the friction locking of the device 30 means that the object 16 is locked vertically, even with loss of power and no other locking mechanism on the drive cylinder.

Figure 10:
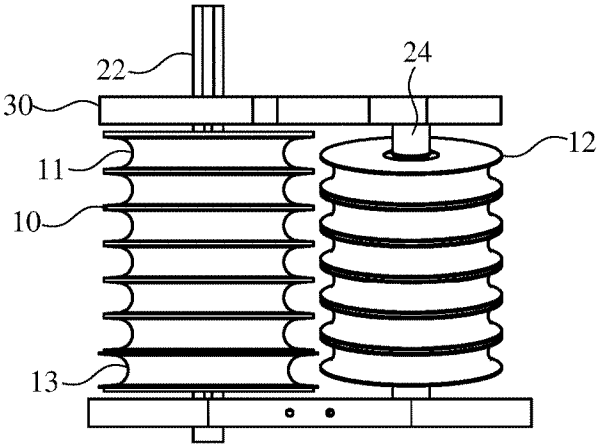
FIG. 10 is an elevation view of a device for moving an object without the line.
Figure 13:
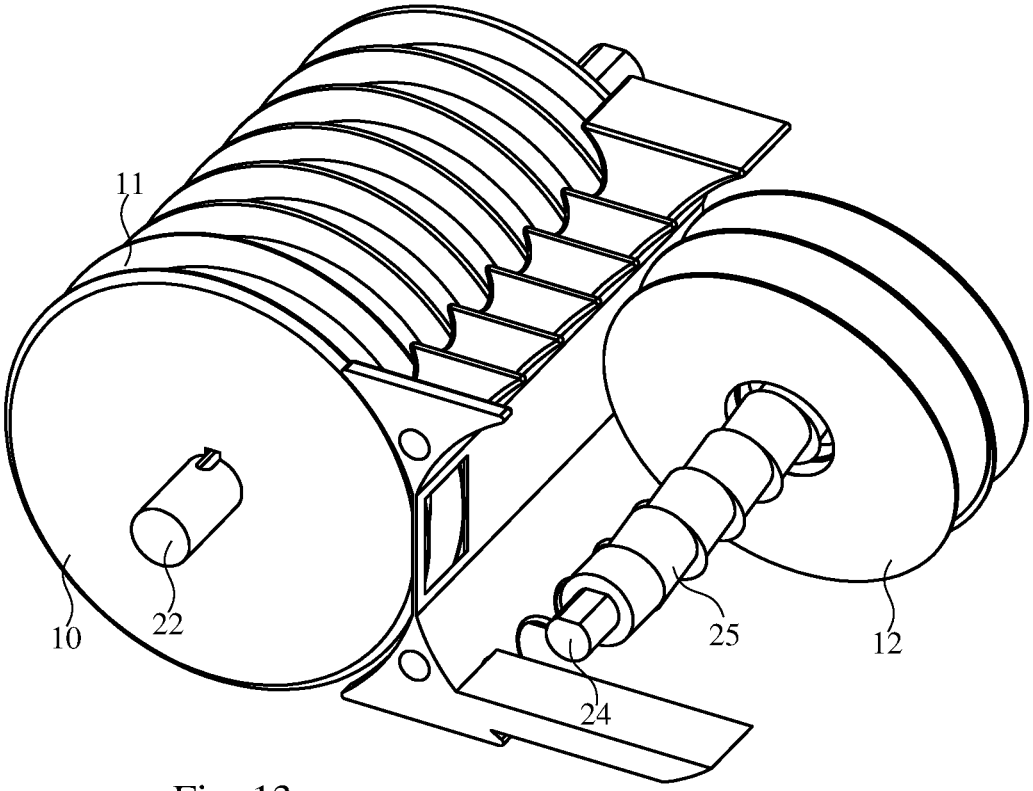
FIG. 13 is a partially exploded isometric view of the device of FIG. 10.
Figure 14:
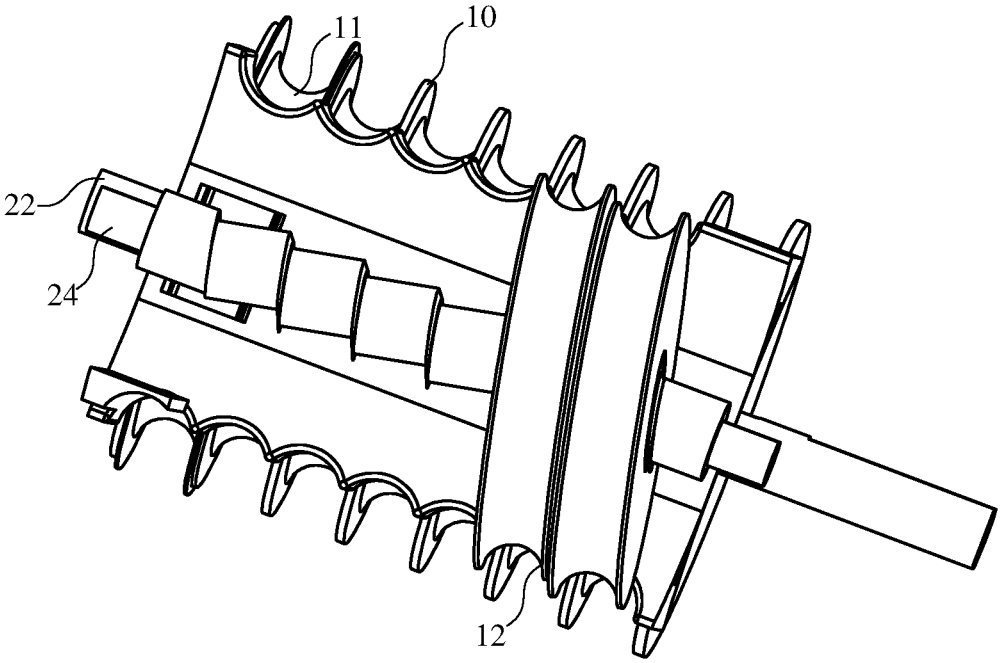
FIG. 14 is a partially exploded isometric view of the device of FIG. 10.

FIG. 10 is an elevation view of a device 30 for moving an object that may be used in one embodiment of the present invention. The device 30 does not show the line 14 or motor 20. However, FIGS. 11 and 12 have the line 14 and motor 20 and reference this Figure. Description of this Figure will be presented in conjunction with FIGS. 11 and 12. FIG. 13 is a partially exploded isometric view of the device of FIG. 10. FIG. 14 is a partially exploded isometric view of the device of FIG. 10.

Figure 11:
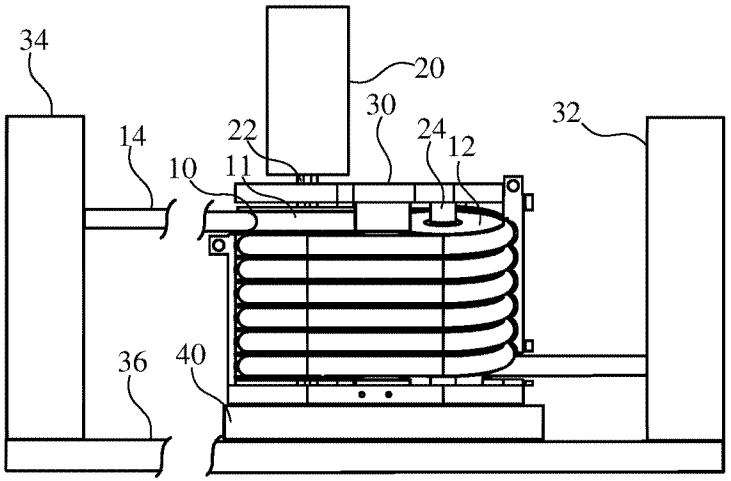
FIG. 11 is an elevation view of a device for moving an object.

FIG. 11 is an elevation view of a device 30 for moving an object 40 that may be used in one embodiment of the present invention. Refer to FIG. 10 for views of the device 30 without the line 14. The device 30 is mounted on the object 40. A drive cylinder 10 rotates on a drive shaft 22 driven by a motor 20. The drive cylinder 10 has drive grooves 11 that are parallel to one another and perpendicular to the long axis of the drive cylinder 10. In this embodiment, a drive groove 13 is larger than the remainder of the drive grooves 11. This larger diameter increases the tension on the line and can minimize or eliminate the need for an outside tensioner to provide tension. Parallel to the drive shaft 22 is an idler shaft 24 with angled idler bearings on which idler pulleys 12 rotate parallel to one another and at an angle to the drive grooves 11. The angle is such that as the line 14 passes around a first of the drive grooves 11 and onto a first of the idler pulleys 12, the line 14, as it comes off the first of the idler pulleys 12, is aligned with a second of the drive grooves 11. This continues across the device 30, with each drive groove 11 being fed line 14 from one of the idler pulleys 12 and then feeding that line 14 to a next of the idler pulleys 12. In other words, the idler pulleys 12 are tilted relative to the drive grooves 11, aligning the grooves of the idler pulleys 12 with adjacent drive grooves 11, allowing the line 14 to wrap around the drum and pulleys without side loading, overlap of line, or movement of the point of line discharge. The line 14 is under tension because the line 14 is affixed under tension to walls 32 and 34 at opposite ends. The wrapping and tension produce a capstan effect on the line 14 such that turning the drive cylinder 10 causes the device 30 and the object 40 to travel along the line 14 towards wall 34 or wall 32.

Figure 12:
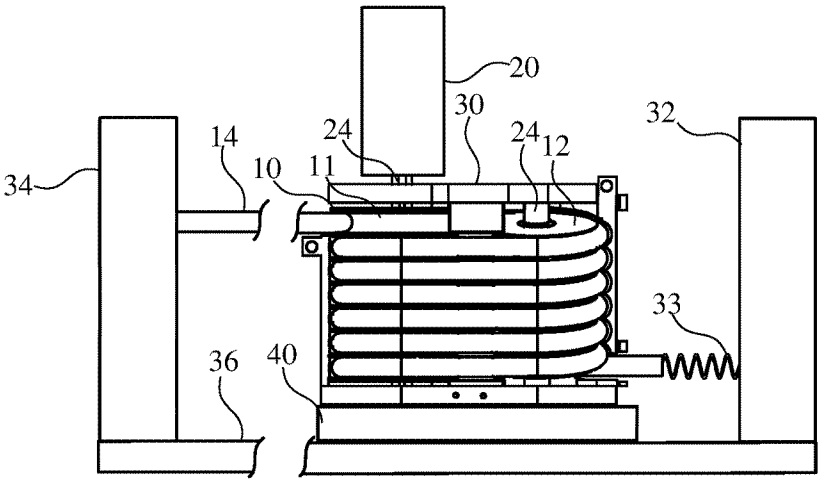
FIG. 12 is an elevation view of a device for moving an object.

FIG. 12 is an elevation view of a device 30 for moving an object 40 that may be used in one embodiment of the present invention. Refer to FIG. 10 for views of the device 30 without the line 14. The device 30 is mounted on the object 40. A drive cylinder 10 rotates on a drive shaft 22 driven by a motor 20. The drive cylinder 10 has drive grooves 11 that are parallel to one another and perpendicular to the long axis of the drive cylinder 10. In this embodiment, a drive groove 13 is larger than the remainder of the drive grooves 11. This larger diameter increases the tension on the line and can minimize or eliminate the need for an outside tensioner to provide tension. Parallel to the drive shaft 22 is an idler shaft 24 with angled idler bearings on which idler pulleys 12 rotate parallel to one another and at an angle to the drive grooves 11. The angle is such that as the line 14 passes around a first of the drive grooves 11 and onto a first of the idler pulleys 12, the line 14, as it comes off the first of the idler pulleys 12, is aligned with a second of the drive grooves 11. This continues across the device 30, with each drive groove 11 being fed line 14 from one of the idler pulleys 12 and then feeding that line 14 to a next of the idler pulleys 12. The line 14 is under tension one end is affixed to wall 34 and the other end is affixed by a spring 33 to wall 32. The wrapping and tension produce a capstan effect on the line 14 such that turning the drive cylinder 10 causes the device 30 and the object 40 to travel along the line 14 towards wall 34 or wall 32.

Figure 15:
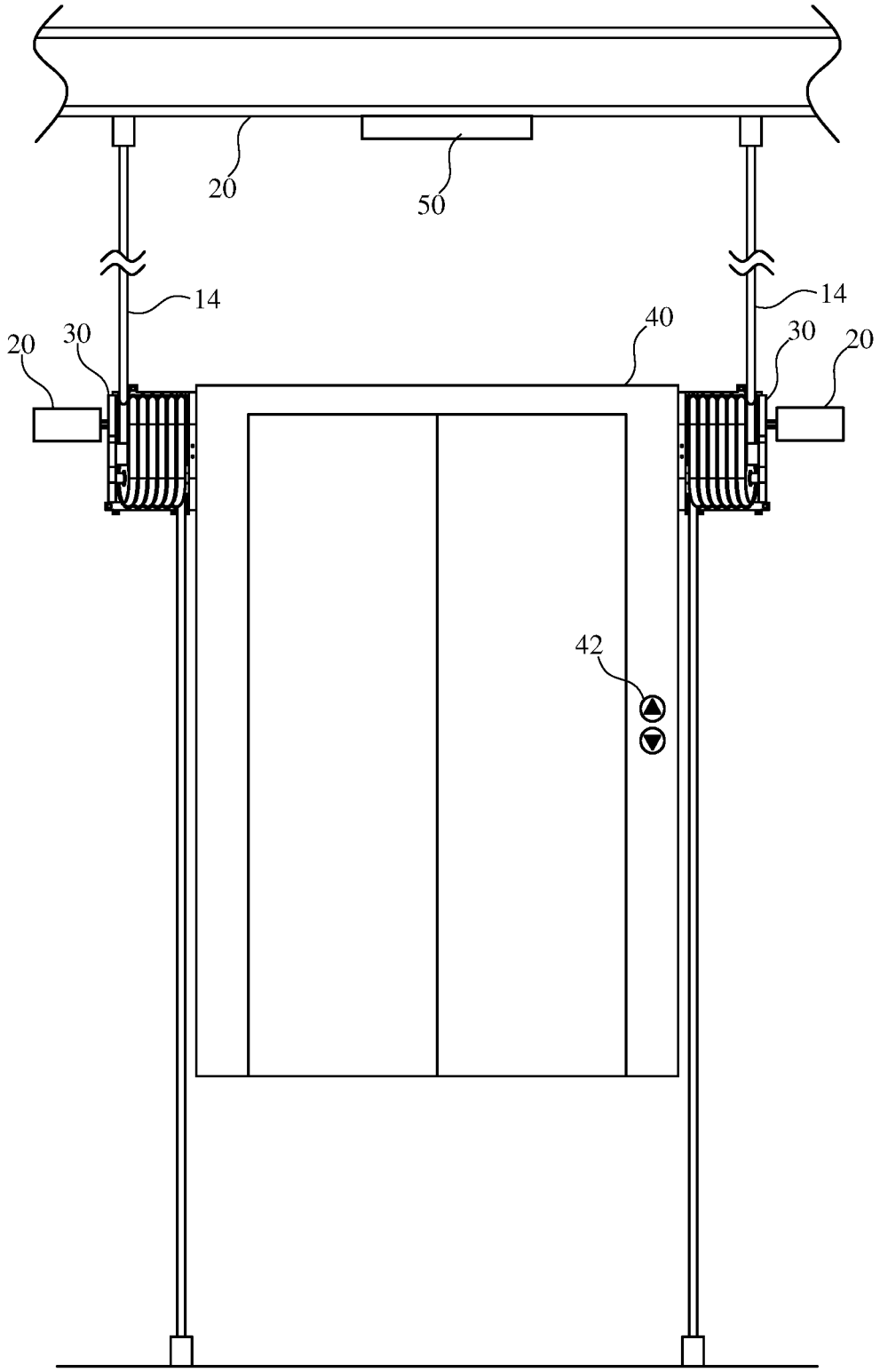
FIG. 15 is an elevation view of an elevator equipped with a device for raising and lowering the elevator.

FIG. 15 is an elevation view of an elevator 40 equipped with a device 30 for raising and lowering the elevator that may be used in one embodiment of the present invention. The devices 30 are the device of FIG. 11. The devices 30 are mounted to the four top corners of the sides of the elevator 40. The lines 14 of the devices 30 attach at one end to the top of the elevator shaft and at the other end to a floor of the elevator shaft. In this embodiment, the lines 14 are attached to the floor with enough tension that the line is under tension. In other embodiments, the lines 14 are attached to a spring that affixes to the floor, the spring providing the needed tension (such as in FIG. 12). The motors 20 turn the drive cylinders of the devices 30, causing the device 30 to climb up or down the lines 14 due to the capstan effect. Call buttons 42 and floor buttons (inside—not shown) signal the controller 50. The controller 50 starts and stops the motors 20 to climb the elevator to the desired elevation.

Figure 16:
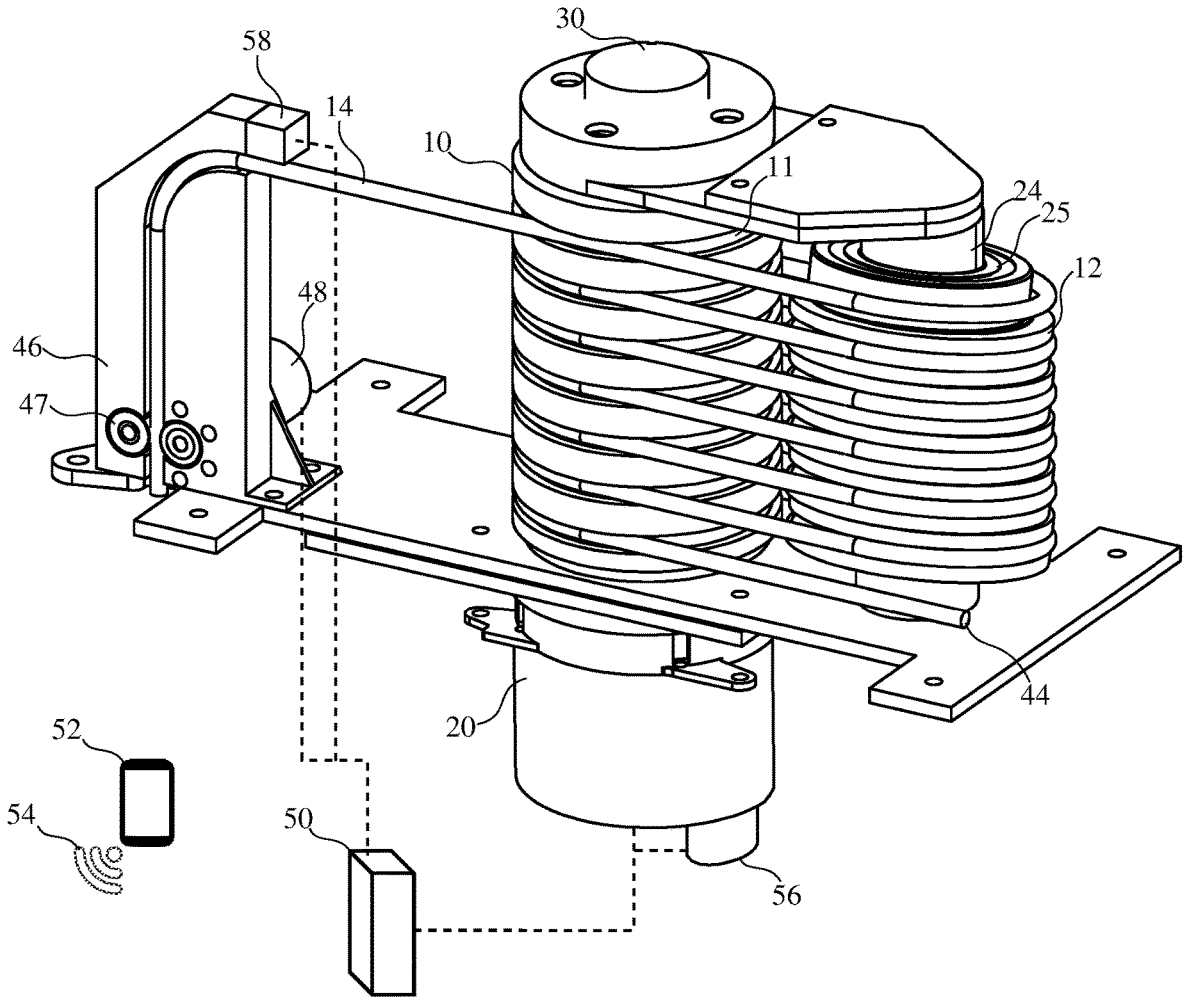
FIG. 16 is an isometric view of a device for moving an object, the device equipped with a line tensioner.

FIG. 16 is an isometric view of a device 30 for moving an object, the device 30 equipped with a line tensioner 46 that may be used in one embodiment of the present invention. A drive cylinder 10 has drive grooves 11 that are parallel to one another and perpendicular to the long axis of the drive cylinder 10. The drive cylinder 10 is driven by a motor 20 powered by a battery 56. Parallel to the drive cylinder 10 is an idler shaft 24 with angled idler bearings 25 on which idler pulleys 12 rotate parallel to one another and at an angle to the drive grooves 11. The angle is such that as the line 14 passes around a first of the drive grooves 11 and onto a first of the idler pulleys 12, the line 14, as it comes off the first of the idler pulleys 12, is aligned with a second of the drive grooves 11. This continues across the device 30, with each drive groove 11 being fed line 14 from one of the idler pulleys 12 and then feeding that line 14 to a next of the idler pulleys 12. In other words, the pulleys are angled so that the front and back of the grooves of each idler pulley 12 aligns with adjacent drive grooves 11. This angle eliminates side loading of the idler pulleys 12. One end of the line 44 extends to the object being moved. The other end of the line enters the line tensioner 46 and is pulled on by rollers 47, driven by motor 48. When the object is being pulled towards the device 30, the rollers 47 pull the line 14 through the line tensioner 46 and into a space, such as a bag or some other cavity, where the line 14 is collected. When the line 14 is pulled back out, the rollers 47 reverse and move such that the line 14 is still under tension, but only enough to maintain tension, not enough to prevent the line end 44 from being returned to a distance away from the device 30.

In this embodiment, a controller 50 controls the motor 20 and the roller motor 48 and receives information from the motor 20, the roller motor 48, the battery 56, and a line counter 58. A smart device 52 can transmit 54 instructions to the controller 50, allowing for the user to control operations. The smart device 52 also receives the information from the controller, allowing the user to see information from sensors such as battery levels, current draw by the motors, how much line remains behind the rollers 47, how much line is extended, how much force is exerted on the line, and other typical information desired by users.

Figure 17:
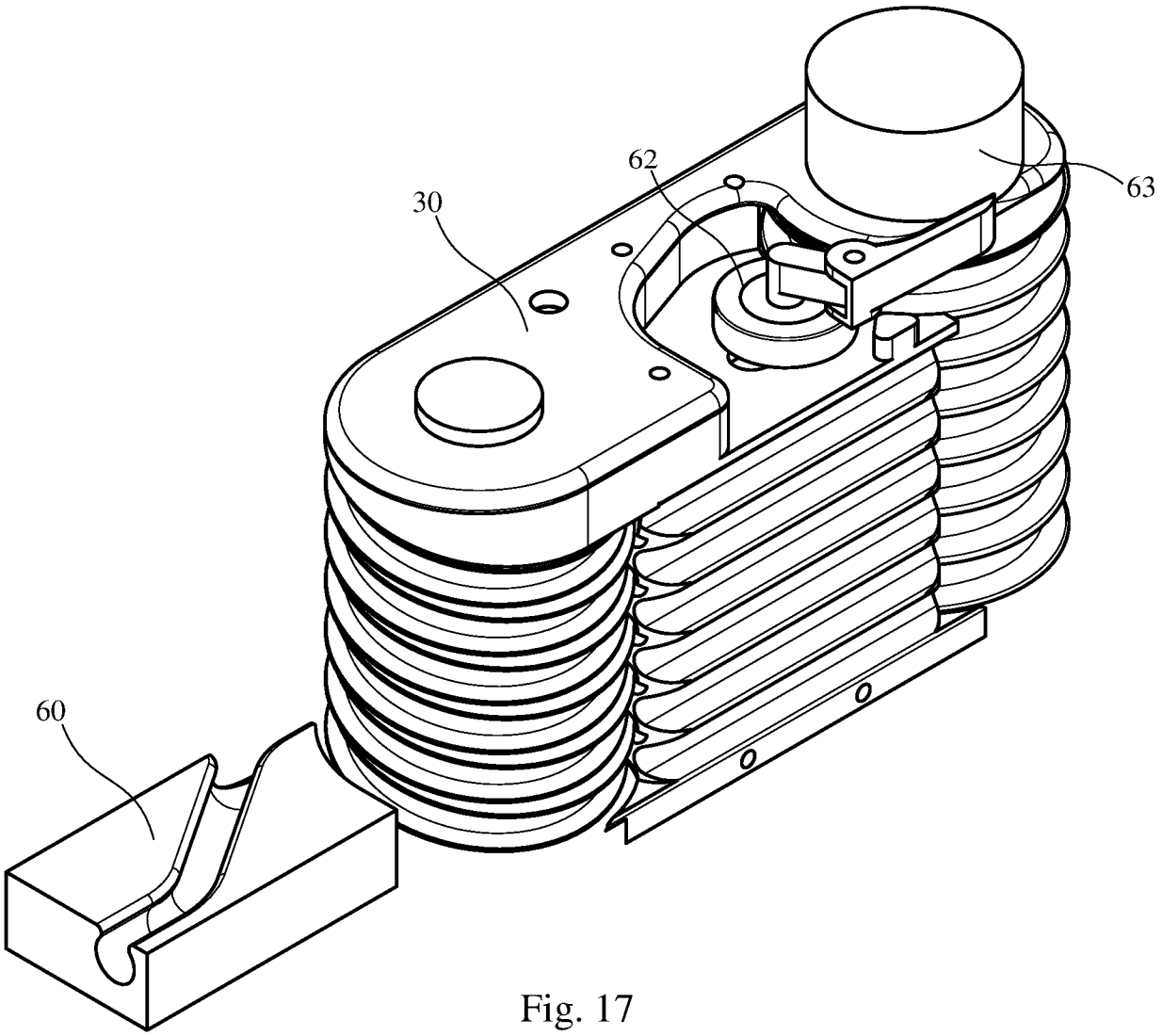
FIG. 17 is an isometric view of a device for moving an object, the device equipped with a line tensioner and a center of mass adjuster.

FIG. 17 is an isometric view of a device for moving an object, the device is equipped with a line tensioner and a center of mass adjuster that may be used in one embodiment of the present invention.

Figure 18:
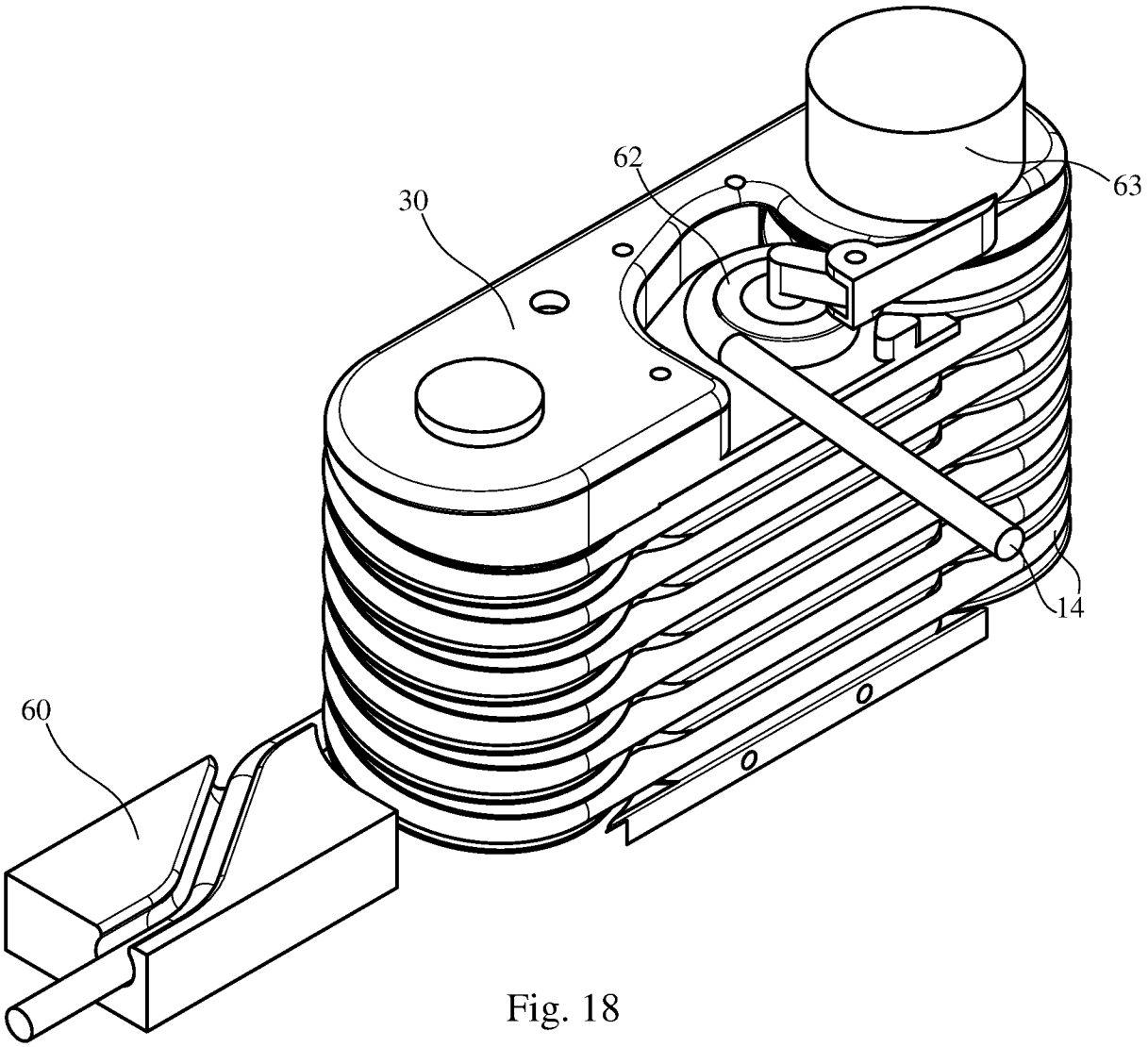
FIG. 18 is an isometric view of the device of FIG. 17 with the line shown.

FIG. 18 is an isometric view of the device of FIG. 17 with the line shown. The device 30 is identical to that of FIG. 16 except that the tensioner is integrated into the body of the device 30 and there is a center of mass adjuster 60. The tensioner consists of a roller 62 and a spring 63. The roller 62 is pushed by the spring 63 against the line 14, producing a tension in the line 14. The center of mass adjuster 60 acts to guide the line from the edge of the device 30 to be in line with the center of mass of the device 30. To balance the device 30 from side to side, the rope needs to enter directly on the center line of the device 30. In one embodiment, the opposite end of the device 30 from the center of mass adjuster 60 will have a hook or other attachment on the same center line. The center of mass adjuster 60 receives the line 14 at the center line of the device 30 and smoothly transitions the line 14 onto the side of the device 30. An increase in the overall length of the groove of the center of mass device 60 decreases the angle at which the line 14 turns and thereby decreases the side loads on the groove.

In one embodiment, the device 30 is mounted to a car and acts as a winch. The line 14 is drawn out by hand, with the motor idling and the rollers motor 48 going in reverse. In another embodiment, the line is drawn out by mechanical means. In a preferred embodiment, the line is drawn out past the amount needed and then it is drawn back in by the controller until it reaches tension. At that point, the device acts as a winch.

In one embodiment, the object is between two of the devices 30, the devices 30 mirrored so that as one pulls the object, the other allows the object to be pulled away, but both sides maintaining tension. In this manner, the object can be pulled back and forth as needed. For example, the object could be a tram that is pulled back and forth along a track.

The invention has been described with reference to various specific and preferred embodiments and techniques. Nevertheless, it is understood that many variations and modifications may be made while remaining within the spirit and scope of the invention.

What is claimed is:

1. A device for moving an object comprising:

a drive cylinder with at least three drive grooves rotating in parallel planes that are perpendicular to a long axis of the drive cylinder;

a shaft parallel to the drive cylinder upon which at least two idler pulleys rotate;

wherein the idler pulleys rotate in planes parallel to each other, which planes are at an angle to the parallel planes of the drive grooves, such that, as a line passes around a first drive groove, onto a first idler pulley, and around the first idler pulley, the line, as it comes off the first idler pulley, is aligned with a second drive groove; and wherein as the line comes around the second drive groove, onto a second idler pulley, and around the second idler pulley, the line, as it comes off the second idler pulley, is aligned with a third drive groove;

wherein the line is attached at a first end to an object and a second end is under tension;

wherein, as the drive cylinder is rotated the object is moved.

2. The invention of claim 1, wherein the tension is supplied by a counterweight, a stationary member, a spring, or a second object pulling away from the device.

3. The invention of claim 1, wherein the tension is supplied by a set of rollers that pull the line away from the device.

4. The invention of claim 1, wherein the first of the drive grooves has a greater diameter than a remainder of the drive grooves.

5. The invention of claim 1, wherein the device is mounted on and moves along a track such that the device lifts the object up, moves to a new location, and lowers the object down.

6. The invention of claim 1, wherein a surface of the at least three drive grooves is rough, resulting in increased frictional gripping of the line by the surface.

7. The invention of claim 1, wherein the drive cylinder is rotated by a motor.

8. The invention of claim 7, further comprising a controller configured to receive instructions and transmit a signal to the motor to rotate the drive cylinder.

9. The invention of claim 8, further comprising a smart device configured to transmit instructions to the controller.

10. The invention of claim 9, further comprising sensors that transmit information to the smart device, the sensors transmitting information selected from the group consisting of a force on the line, a position of the line in the device, power remaining in a battery that drives the motor, current draw by the motor, and combinations thereof.

11. The invention of claim 7, wherein the motor is powered by a battery.

12. A device for moving an object comprising:

a drive cylinder with at least three drive grooves rotating in parallel planes that are perpendicular to a long axis of the drive cylinder, the drive cylinder mounted to the object;

a shaft parallel to the drive cylinder upon which at least two idler pulleys rotate;

wherein the idler pulleys rotate in planes parallel to each other and at an angle to the parallel planes of the drive grooves, such that, as a line passes around a first drive groove, onto a first idler pulley, and around the first idler pulley, the line, as it comes off the first idler pulley, is aligned with a second drive groove; and wherein as the line comes around the second drive groove, onto a second idler pulley, and around the second idler pulley, the line, as it comes off the second idler pulley, is aligned with a third drive groove;

wherein the line is attached at a first end to a stationary member and is attached at a second end to a stationary member or is under tension; and wherein, as the drive cylinder is rotated the device travels along the line towards the first end or the second end, moving the object.

13. The invention of claim 12, wherein a first of the drive grooves has a greater diameter than a remainder of the drive grooves.

14. The invention of claim 12, wherein the drive cylinder is rotated by a motor.

15. The invention of claim 14, further comprising a controller configured to receive instructions and transmit a signal to the motor to rotate the drive cylinder.

16. The invention of claim 15, further comprising a smart device configured to transmit instructions to the controller.

17. A system for moving an object linearly comprising a plurality of the devices of claim 12 mounted on one or more faces of the object.

18. The invention of claim 17, wherein each of the plurality of the devices comprises a motor that drives the drive cylinder.

19. The invention of claim 18, further comprising a controller configured to receive instructions and transmit a signal to the motors to rotate the drive cylinder.

20. The invention of claim 19, wherein the object comprises an elevator and further comprising a set of buttons that transmit the instructions to the controller.

* * * * *